United States Patent [19]

Willerding

[11] Patent Number: 4,708,269

[45] Date of Patent: Nov. 24, 1987

[54] PLUNGER-OPERATED DISPENSING DEVICE

[75] Inventor: J. Willerding, Driebergen, Netherlands

[73] Assignee: Stork Bepak B.V., Utrecht, Netherlands

[21] Appl. No.: 882,361

[22] Filed: Jul. 7, 1986

[30] Foreign Application Priority Data

Jul. 10, 1985 [NL] Netherlands ..... 8501983

[51] Int. Cl.[4] ..... B67D 5/40

[52] U.S. Cl. ..... 222/377; 222/309; 222/148; 134/169 R

[58] Field of Search ..... 222/148, 149, 151, 380, 222/168.5, 309, 372, 383, 384, 377, 333, 334; 141/146, 142, 287–91; 134/169 R, 22.1

[56] References Cited

U.S. PATENT DOCUMENTS

| | | | |
|---|---|---|---|
| 1,874,612 | 8/1932 | Peterson | 222/309 |
| 3,349,973 | 10/1967 | Smith | 222/168.5 |
| 3,580,302 | 5/1971 | Riesenberg | 222/168.5 |
| 3,693,640 | 9/1972 | Wettlen et al. | 222/148 |
| 4,298,575 | 11/1981 | Berglund | 222/309 |

*Primary Examiner*—Joseph J. Rolla
*Assistant Examiner*—Kenneth Noland
*Attorney, Agent, or Firm*—Watson, Cole, Grindle & Watson

[57] ABSTRACT

A plunger-operated dispensing device for liquids includes a stock container for a liquid, at least one vertical dispensing cylinder with a dispensing plunger therein which can be moved in the axial direction of the dispensing cylinder between two end positions. The lower end of the cylinder is in communication with the stock container via a channel having a movable shut-off valve therein. The outside diameter of the dispensing plunger is smaller than the inside diameter of the dispensing cylinder is that a certain space is present between the wall of the cylinder and the plunger. Near its lower end the dispensing plunger is provided with a sealing ring for sealing the space between the cylinder wall and the plunger. The movement stroke of the dispensing plunger can be displaced in the direction of the lower end of the dispensing cylinder, such that, in the lower end position of the plunger, the sealing ring of the plunger reaches past the lower end of the dispensing cylinder. In this position cleaning liquid can flow from the stock container via the communication channel and past the shut-off valve to the space between the dispensing plunger and the wall of the dispensing cylinder, as a result of which a thorough cleaning of all the components becomes possible without the need to dismantle the dispensing device.

4 Claims, 6 Drawing Figures

PLUNGER-OPERATED DISPENSING DEVICE

BACKGROUND OF THE INVENTION

1. Field of the Invention

The invention relates to a plunger-operated dispensing device for liquids, comprising a stock container for a liquid, at least one dispensing cylinder with a dispensing plunger therein which can be moved in the axial direction between two end positions, one side of the cylinder being in communication with the stock container via a channel having a shut-off valve therein which can be operated, and also control means for controling the movement of the dispensing plunger and operating means for operating the shut-off valve.

2. The Prior Art

A device of the noted type is known. It comprises a rotatable stock container and a number of dispensing cylinders disposed in a circle around it, the centre lines whereof are parallel to the axis of rotation of the stock container. In each dispensing cylinder there is incorporated a dispensing plunger which can be moved up and down between two extreme positions. The bottoms of the cylinders, which are completely open, are in combination with the bottom of the stock container. In the communication channel between the dispensing cylinder and the stock container there is incorporated a shut-off valve which has two working positions. In one position the feed opening of the stock container is open to the communication channel and the dispensing opening through which the liquid can be dispensed is closed so that the liquid can flow from the stock container to the dispensing cylinder. In the other position the feed opening is shut off and the dispensing opening is opened so that liquid can be dispensed through the dispensing opening.

An important disadvantage of noted device is that there are no provisions for cleaning the device, and in particular the dispensing cylinders, the dispensing plungers and the shut-off valves in situ. When a liquid subject to deterioration is processed in a device of this type, cleaning is necessary on a regular basis for hygienic reasons. It becomes necessary to dismantle the dispensing part of the device for manual cleaning.

An operation of this type is time-consuming and costly. In addition, damage may take place to the components removed, as a result of which premature replacement of the components has to take place, which also increases costs.

SUMMARY OF THE INVENTION

It is an object of the invention is to eliminate such disadvantages and to provide a device in which in situ cleaning, i.e. without dismantling, is in fact possible and, in addition, is effective.

This object is achieved according to the invention by a device of the above-mentioned type which is characterized in that the outside diameter of the dispensing plunger is smaller than the inside diameter of the dispensing cylinder so that a certain space is present between the wall of the cylinder and the plunger, near the end which is situated on the side of the end of the dispensing cylinder which is in communication with the stock container the dispensing plunger is provided at the circumference with sealing means for sealing the space between the cylinder wall and the plunger, and adjustment means are present for displacing the movement stroke of the dispension plunger so far in the direction of the end of the dispensing cylinder, which is in communication with the stock container, that in one of the end positions of the plunger the sealing means of the plunger reach past the end of the dispensing cylinder which is in communication with the stock container.

As a result of these measures it is possible to feed cleaning liquid from the stock container via the communication channel and past the shut-off valve to the space between the dispensing plunger and the wall of the dispensing cylinder, as a result of which a through cleaning of all the components becomes possible without the dispensing device having to be dismantled. If the dispensing plunger is moved backwards and forwards during the cleaning, i.e., liquid is periodically pressed out of the dispensing cylinder and is drawn in again, the cleaning liquid is conveyed into the gap along the cylinder wall by means of the sealing means, while the sealing means have a scraping action as a result of which the cylinder wall is subjected to better cleaning than in the case of the known device in which the plunger is drawn in its entirety out of the cylinder and is rinsed around in this position with cleaning liquid. In addition, it is possible for the quantity of cleaning liquid which is required to clean the cylinders in the device according to the invention to be much smaller than in the known device since in the device according to the invention the cylinders can be cleaned one after the other.

Preferably the end of the dispensing cylinder which is in communication with the stock container is provided with a radius or a sloping edge which widens towards the end of the dispensing cylinder, as a result of which the sealing means is not damaged when it is drawn into the dispensing cylinder.

Expediently, the dispensing plunger is provided near the two ends with first and second guide means which interact with the cylinder wall, at least the first guide means situated near the sealing means having at least one channel which alows liquid through and which connects the spaces situated on either side of the first guide means to each other.

As a result of this it is possible for a good guiding of the plunger in the cylinder to take place when the sealing means on the plunger are located in the widened end part of the cylinder and are consequently no longer in contact with the cylinder wall, and the supply of cleaning liquid to the space between the plunger and the cylinder is not blocked by the guide means.

In a practical embodiment the dispensing plunger is constructed in a separable manner, the plane of separation being essentially transverse to the axis of the plunger and being disposed in a position such that the sealing means and the first guide means are disposed on the detachably constructed part situated on the side of the end of the cylinder which is in communication with the stock container.

As a result of this, the components of the plunger which are subject to wear can easily be replaced. The plungers can simply be drawn out of the cylinders in a certain part of the device.

Expediently, the dispensing cylinder is provided with an opening which is disposed in the cylinder wall at a distance from the end of the cylinder which is in communication with the stock container in a manner such that liquid fed past the first guide means can be discharged therethrough, in which circumstances the discharged liquid will be essentially contaminated cleaning liquid.

The invention will now be explained on the basis of an exemplary embodiment by means of the drawings.

DETAILED DESCRIPTION OF THE PREFERRED EMBODIMENT

Figure 1:
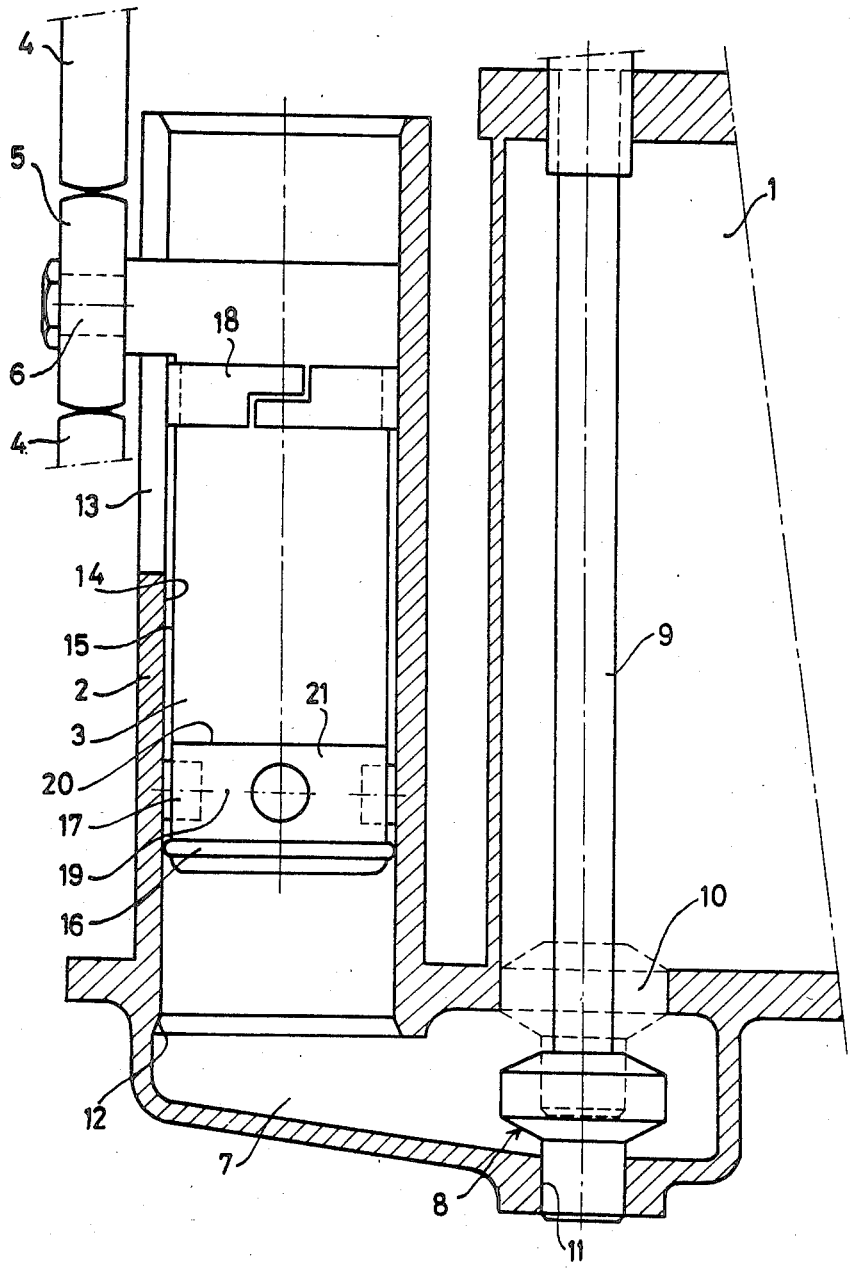
FIG. 1 is a view in section of a part of the device according to the invention.

The plunger-operated dispensing device partially shown in FIG. 1 consists of a rotating stock container 1, a number of dispensing cylinders 2 which are disposed in a ring around the stock container 1 and the centre line of which runs parallel to the axis of rotation of the stock container 1. In each dispensing cylinder 2 there is incorporated a dispensing plunger 3 which can be moved up and down between two extreme positions. The movement of each of the plungers 3 is controlled during the rotation of the stock container 1 and the cylinders 2 by a guide track 4 which interracts with a roller 5 which is rotatably mounted on a pin 6 attached to the plunger 3.

The bottom of the dispensing cylinder 2 is completely open and is in communication with the bottom of the stock container 1 by means of a communication channel 7. In the communication channel 7 there is incorporated a shut-off valve 8 which can be moved by means of operating means (not shown) into two positions via a rod 9 extending through the stock container 1. In one position, shown in FIG. 1 by full lines, the feed opening 10 of the stock container 1 is open to the communication channel 7 and the dispensing opening 11 through which the liquid can be dispensed is closed.

In the other position, which is shown by broken lines in FIG. 1, the feed opening 10 is closed and the dispensing opening 11 is open.

At the bottom of the dispensing cylinder 2 the inside diameter becomes greater over a certain distance towards the end so that the cylinder 2 is provided with a bell-shaped widened end part 12.

The dispensing cylinder 2 is further provided with a slot-shaped opening 13 for guiding the pin 6 for the roller 5 and a second function whereof will be explained below. The inside diameter of the dispensing cylinder 2 is larger than the outside diameter of the dispensing plunger 3 so that a certain gap 15 is present between the cylinder wall 14 of the dispensing cylinder 2 and the plunger 3.

The dispensing plunger 3 is provided at the circumference near the bottom end with a sealing ring 16 for sealing the gap 15.

The dispensing plunger 3 is also provided near both end with first and second guide means 17, 18, for example, in the form of plugs 17 disposed in the plunger and a piston ring 18 disposed at the circumference of the plunger, which interract with the cylinder wall 14. The first guide means 17 has at least one channel 19 which allows liquid through and which connects the gaps situated on either side of the guide means 17 to each other, and the function of which will be explained below.

The dispensing plunger 3 is constructed in a separable manner, the separation plane 20 being essentially transverse to the axis of the plunger and being disposed in a position such that the sealing means 16 and the first guide means 17 are disposed on the detachable part 21 of the plunger 3 which is situated at the side of the end 12 of the cylinder 2.

Figure 2:
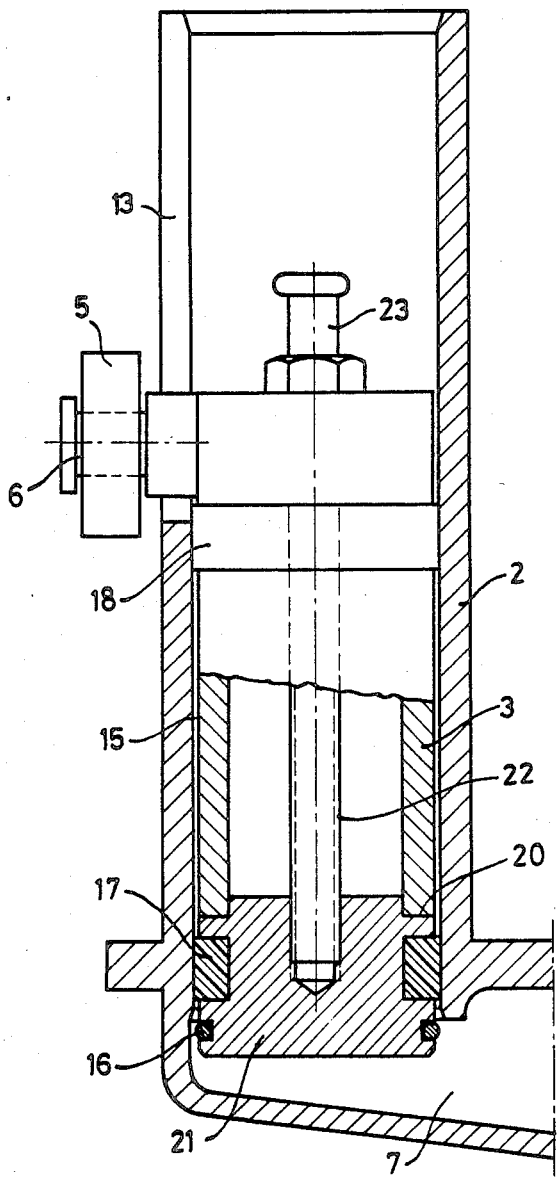
FIG. 2 is a partial longitudinal section of the dispensing cylinder and the dispensing plunger of the device of FIG. 1.

As is to be seen in FIG. 2, the various components of the plunger are linked to each other by means of a plunger rod 23 provided with a screw thread 22.

The device is further provided with adjustment means which can displace the guide track 4 or the plunger 3 in the vertical direction in a manner such that in the lowermost position of the plunger 3 the sealing ring 16 may reach down to or past the end 12 of the cylinder 2.

The operation of the dispensing device described above will now be described in more detail.

Figure 3:
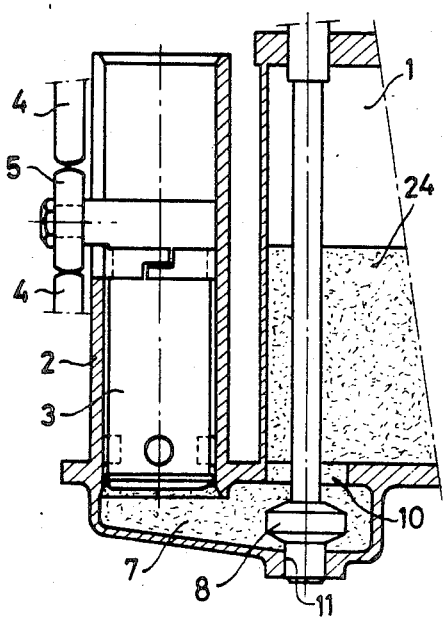
FIGS. 3 to 6 incl. show the device of FIG. 1 during various phases of the dispensing process and the cleaning process.

During normal operation (see FIGS. 3 and 4) the stock container 1 is filled with the liquid 24 to be dispensed and the container rotates around its axis of rotation. A quantity of liquid to be dispensed is transferred from the container 1 to the dispensing cylinder 2 by moving the dispensing plunger 3 from the lowermost end position shown in FIG. 3 to the uppermost end position shown in FIG. 4 by means of the guide track 4 with the position of the shut-off valve 8 shown in FIG. 3, the feed opening 10 being open and the dispensing opening 11 being closed. A certain quantity of the liquid 24 then flows via the feed opening 10 and the communication channel 7 to the space in the dispensing cylinder 2 underneath the plunger 3.

Figure 4:
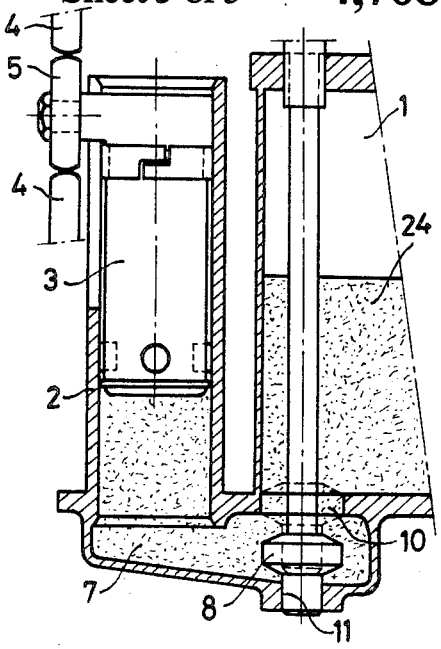

The shut-off valve is then brought by means of the operating means thereof to the position shown by broken lines in FIG. 4, the feed opening 10 being closed and the dispensing opening 11 being open. The dispensing plunger 3 is then moved downwards and the quantity of the liquid 24 to be dispensed is discharged through the dispensing opening 8. The shut-off valve 8 is then brought back to the position shown in FIG. 3 and the cycle is repeated.

Figure 5:
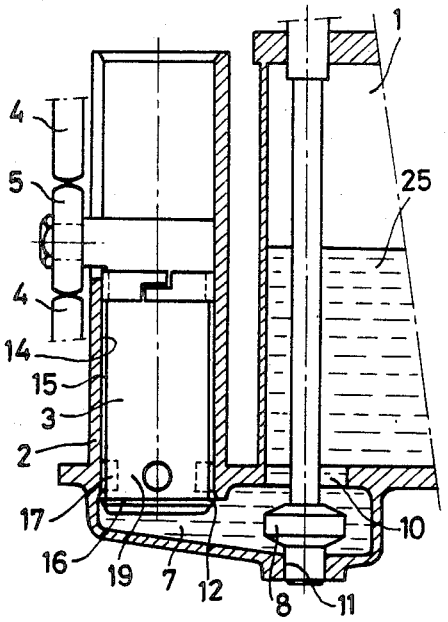
Figure 6:
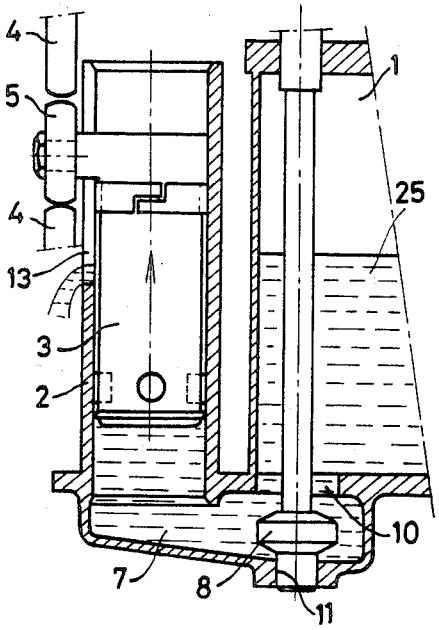

When the device has to be cleaned, the supply of the liquid to be dispensed to the stock container 1 is stopped and the device is operated until the stock container 1 is empty. The stock container 1 and the dispensing device are then rinsed with rinsing liquid, the procedure described above being followed. The guide track 4 is then brought at least partially downwards by means of the adjusting means present in the device. Depending on the type of adjusting means this may take place with the device rotating or stationary. After this, if the machine is stopped, it is again put into operation after the stock container 1 has been connected to the supply of cleaning liquid 25. The device is then operated for some time with cleaning liquid in the same manner as for dispensing liquid, but with the difference that the shut-off valves 8 now remain continuously in the position shown in FIG. 5 and the movement stroke of the plunger 3 in the cylinder 2 has been displaced downwards in a manner such that in the lowermost extreme position of the plunger 3 the sealing ring 16 reaches past the end 12 of the cylinder 2. During the cleaning the dispensing opening 11 continuously remains closed and the feed opening 10 continuously remains open. Because the sealing ring 16 reaches into or past the end 12 of the cylilnder 2, as a result of which a gap is produced between the sealing ring 16 and the end 12 of the cylinder 2 and the first guide means 17 are provided with channels 19 which allow liquid through, cleaning liquid can flow into the space 15 between the cylinder wall 14 and the plunger 3. When the plunger 3 moves upwards, the cleaning liquid is discharged via the opening 13 in the wall of the cylinder 2 as is indicated in FIG. 6. In this manner the various components of the dispensing device are thoroughly cleaned without the dispensing device having to be dismantled.

After the dispensing device has been cleaned, the supply of cleaning liquid 25 to the stock container 1 is shut-off and the shut-off valves 8 are again operated normally until the stock container 1 and the cylinders 3 are completely empty.

If necessary, the device is then rinsed again with rinsing liquid, the procedure to be followed corresponding to the procedure for cleaning.

Finally, the guide track 4 is again placed in the original position, after which the dispensing device is then ready for dispensing the product liquid in a completely cleaned and optionally rinsed condition.

With the passage of time the sealing ring 16 and/or the guide means 17 may be worn to such an extent that they should be replaced. This can be done in a simple manner by detaching the detachable part 21 of the plunger 3 and replacing the sealing ring 16 and/or the guide means 17. In this process the plunger 3 is drawn out of the cylinder 2 and the part 21, which is constructed as a replacement part, can be replaced in its entirety.

What is claimed is:

1. A plunger-operated dispensing device for liquids which comprises a stock container for the liquid to be dispensed, said stock container having a feed opening, a substantially vertically oriented dispensing cylinder positioned adjacent said stock container, said dispensing cylinder including an inner surface having an inside diameter, channel means connecting a lower end of said dispensing cylinder with said feed opening of said stock cylinder and defining a dispensing channel, a movable valve means for opening and closing said feed opening and said dispensing channel, operating means for moving said valve means, a dispensing plunger which is axially movable within said dispensing cylinder between upper and lower end positions, said dispensing plunger having upper and lower ends and defining outside diameter which is smaller than said inside diameter of the inner surface of said dispensing cylinder, thereby leaving a space therebetween, sealing means on said dispensing plunger near the lower end thereof for sealing against the inside wall of said dispensing cylinder, a first guide means on said dispensing plunger near the lower end thereof for guiding said dispensing plunger within said dispensing cylinder, said first guide means being located above said sealing means, a second guide means on said dispensing plunger near the upper end thereof for guiding said dispensing plunger within said dispensing cylinder, control means for controlling the movement of said dispensing plunger within said dispensing cylinder, and adjustment means for moving said dispensing plunger downwardly past the lower end position thereof and such that the sealing means thereof will be positioned below the lower end of the dispensing cylinder.

2. The device of claim 1, wherein the inner wall of said dispensing cylinder has a lower end portion which is provided with a radius or a sloping edge which widens towards the lower end of the dispensing cylinder.

3. The device of claim 1, wherein said first guide means comprises at least three outward-extending plugs disposed in the lower part of the plunger between which channels are formed, allowing the passage of liquid.

4. The device of claim 1, wherein the dispensing plunger is constructed of an upper part and a lower part, said upper part and said lower part being separable along a plane which is essentially perpendicular to the axis of the plunger, and wherein said sealing means and said first guide means are disposed on said lower part.

* * * * *